United States Patent [19]

Czapka et al.

[11] Patent Number: 4,785,732

[45] Date of Patent: Nov. 22, 1988

[54] PUSH ROD STROKE ADJUSTMENT DEVICE FOR A PRESS

[75] Inventors: Robert Czapka, Eislingen; Alfred Bareis, Uhingen, both of Fed. Rep. of Germany

[73] Assignee: L. Schuler GmbH, Goeppingen, Fed. Rep. of Germany

[21] Appl. No.: 57,358

[22] Filed: Jun. 3, 1987

[30] Foreign Application Priority Data

Jun. 6, 1986 [EP] European Pat. Off. ..... 86107769.1

[51] Int. Cl.[4] ..... B30B 1/26

[52] U.S. Cl. ..... 100/257; 74/571 M

[58] Field of Search ..... 100/257, 282; 83/530, 83/626, 632; 384/294, 430; 74/571 M, 568 R

[56] References Cited

U.S. PATENT DOCUMENTS

| | | | |
|---|---|---|---|
| 3,049,029 | 8/1962 | Schaming | 100/257 |
| 3,358,591 | 12/1967 | Bradlee | 100/257 |
| 3,785,282 | 1/1974 | Kamelander | 100/257 |
| 4,156,387 | 5/1979 | Portmann . | |

FOREIGN PATENT DOCUMENTS

| | | | |
|---|---|---|---|
| 2534626 | 3/1976 | Fed. Rep. of Germany . | |
| 2542070 | 3/1977 | Fed. Rep. of Germany . | |
| 2740382 | 3/1979 | Fed. Rep. of Germany . | |
| 2855579 | 7/1980 | Fed. Rep. of Germany . | |
| 8127545 | 3/1983 | Fed. Rep. of Germany . | |
| 3408662 | 8/1985 | Fed. Rep. of Germany | 100/257 |
| 3421184 | 12/1985 | Fed. Rep. of Germany . | |
| 541734 | 10/1973 | Switzerland . | |
| 554328 | 6/1943 | United Kingdom . | |
| 2103325 | 2/1983 | United Kingdom | 100/257 |

OTHER PUBLICATIONS

"Verbindungselemente", Karl-Heinz Decker, Carl Hanser Verlag, Munich, 1963, pp. 284–285—no translation.

*Primary Examiner*—Andrew M. Falik

*Attorney, Agent, or Firm*—Barnes & Thornburg

[57] ABSTRACT

An arrangement for a press with an eccentric shaft used for the adjustment of the stroke of the ram of the press by adjusting the relative eccentricity of an eccentric and of an eccentric bushing supported thereon, which in turn adjusts the connecting rod of the ram. The eccentric bushing is selectively releasable and fixable in the direction of rotation on the eccentric by actuating means, whereby the released eccentric bushing is fixed with respect to a non-rotating part of the press and with the eccentric shaft and is rotatable in this fixed condition for purposes of adjusting the ram stroke. The fixing of the eccentric bushing on the eccentric occurs steplessly and positively by supporting the eccentric bushing on an oversize eccentric in a press-fit connection having cylindrical fitting surfaces established between the bushing and eccentric and wherein the press-fit connection is releasasble by supplying pressure oil by way of at least one groove to at least one fitting surface.

11 Claims, 4 Drawing Sheets

1
2
3
4
5
6
7
8
9
10
11
12
13
14
15
16
17
23
24
II
III

PUSH ROD STROKE ADJUSTMENT DEVICE FOR A PRESS

BACKGROUND OF THE INVENTION

The present invention relates to an arrangement in a press with an eccentric shaft for the adjustment of the ram stroke by adjusting the resulting eccentricity of an eccentric and of an eccentric bushing supported thereon, on which is supported a connecting rod, whereby the eccentric bushing is selectively released and fixed in the direction of rotation on the eccentric by actuating means, and whereby the released eccentric bushing is fixed at a part non-rotating with the eccentric shaft and the eccentric shaft is rotated in this fixed condition for the purpose of adjusting the ram stroke.

Such arrangements are known, for example, from the DE-A 25 34 626, from the DE-A 27 40 382, from the DE-A 34 21 184 and from the DE-U 81 27 545, and more particularly for presses with only a single connecting rod (single-point presses) as as well as for those with several connecting rods (multi-point presses). Common to all of these prior art arrangements is the fact that for disengaging and fixing the eccentric bushing on the eccentric, they use a fixed and locked operating actuating means such as internal teeth, external teeth and end teeth and claw rings. These types of actuating means have disadvantages in that they can be brought into engagement only in steps by reason of the fixed and locking inter-engagement. Thus the engagement cannot be completely free of play and the danger of subsequent misalignment exists during operation of the machine and in case of frequent actuation of the adjustment.

SUMMARY OF THE INVENTION

Accordingly, it is the object of the present invention to avoid these disadvantages and to enable a stepless, and positive fixing of the eccentric bushing on the eccentric which is permanently insensitive to misalignment.

The underlying problems are solved according to the present invention in an arrangement of the aforementioned type in that the bearing support of an oversized eccentric bushing on the eccentric, is accomplished by a press-fit or interference-fit connection with cylindrical fitting surfaces established between these two parts. This is accomplished by heating the bushing so it expands and thus can be more easily slipped over the eccentric. Further, relative movement between the press-fitted connection of the bushing and the eccentric is obtained by supplying oil under pressure by way of at least one groove to at least one fitting surface to provide a pressure film between the bushing and eccentric which separates them and allows for relative rotation therebetween.

Such press-fit (interference-fit) connections are known as disengageable connections, for example, from the technical book, "Verbindungselemente" ["Connecting Elements"] by Decker, Carl Hanser publication, Munich, September 1963, pages 284–285. However, these press-fit connections serve only to connect the parts in a predetermined mutual position and to disengage the same, for example, during disassembly of a machine.

A frequent disengagement and re-engagement in a different angular position of the parts to one another, is thereby neither provided for, nor aimed at in this prior publication. The advantages of the stepless fixing ability and the non-sensitivity against misalignments in case of frequent actuation are not utilized in the known applications of press-fit connections.

The first (initial) assembly of the press-fit connection occurs either in the presence of a temperature difference between the eccentric bushing and the eccentric to provide relative clearance therebetween by heating and expansion of the bushing, or by pressure medium actuation of the hollow space delimited by the cylindrical fitting surface in the eccentric bushing.

Appropriately, an axial pressure oil line with at least one connecting line to the groove is provided in the eccentric shaft whereby the feed of oil under pressure to the fitting surfaces can be simplified.

ADDITIONAL FEATURES AND ADVANTAGES

For a press with two connecting rods the arrangement according to the present invention preferably includes on the eccentric shaft, two unidirectional eccentrics of the same eccentricity with eccentric bushings of the same eccentricity supported thereon. The required synchronism of the actuation can be easily attained therewith. In case such a press is to be operated with high stroke numbers (high-speed press), a mass compensation has to be provided preferably in the form of a compensating mass movable in the opposite direction to the ram. In order to correspondingly adjust and match the stroke thereof with an adjustment of the ram stroke, two possibilities exist namely, either that the eccentric shaft includes at least one eccentric which cooperatively engages a surrounding eccentric form and which is directed diametrically opposite to at least another eccentric with same eccentricity, and in that eccentric bushings of identical eccentricity are supported on all eccentrics, or that the eccentric shaft includes at least one eccentric which is directed diametrally opposite to at least one eccentric of different eccentricity, and in that the ratio of the eccentricities of the eccentric bushings to the eccentricities of the eccentrics is the same with all eccentric-/eccentric bushing pairs.

Control of the stepless angular adjustment is provided through angle transmitter disks, arranged coaxially on the eccentric shaft, of which at least one is non-rotatably connected with the eccentric shaft and at least one per eccentric bushing is rotatably supported on the eccentric shaft and is non-rotatably connected with the associated eccentric bushing and in that at least one spatially fixedly arranged contactless sensor is coordinated to each angle transmitter disk.

BRIEF DESCRIPTION OF THE DRAWINGS

These and other objects, features and advantages of the present invention will become more apparent from the following description when taken in connection with the accompanying drawings which shows, for purposes of illustration only, one embodiment in accordance with the present invention, and wherein.

DETAILED DESCRIPTION OF THE DRAWINGS

Figure 3:
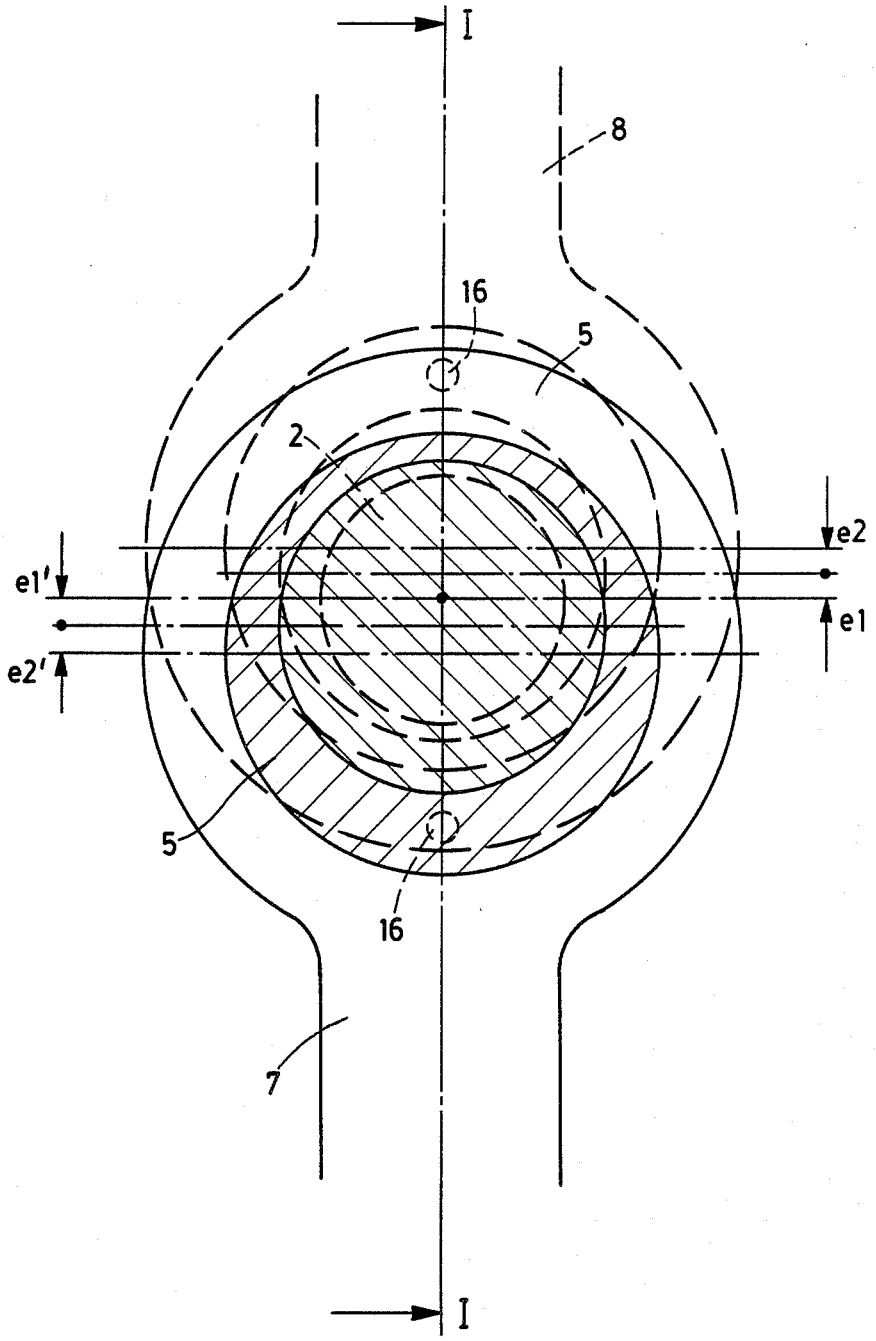
FIG. 3 is an end view of the eccentric drive taken along line III—III of FIG. 1.
Figure 4:
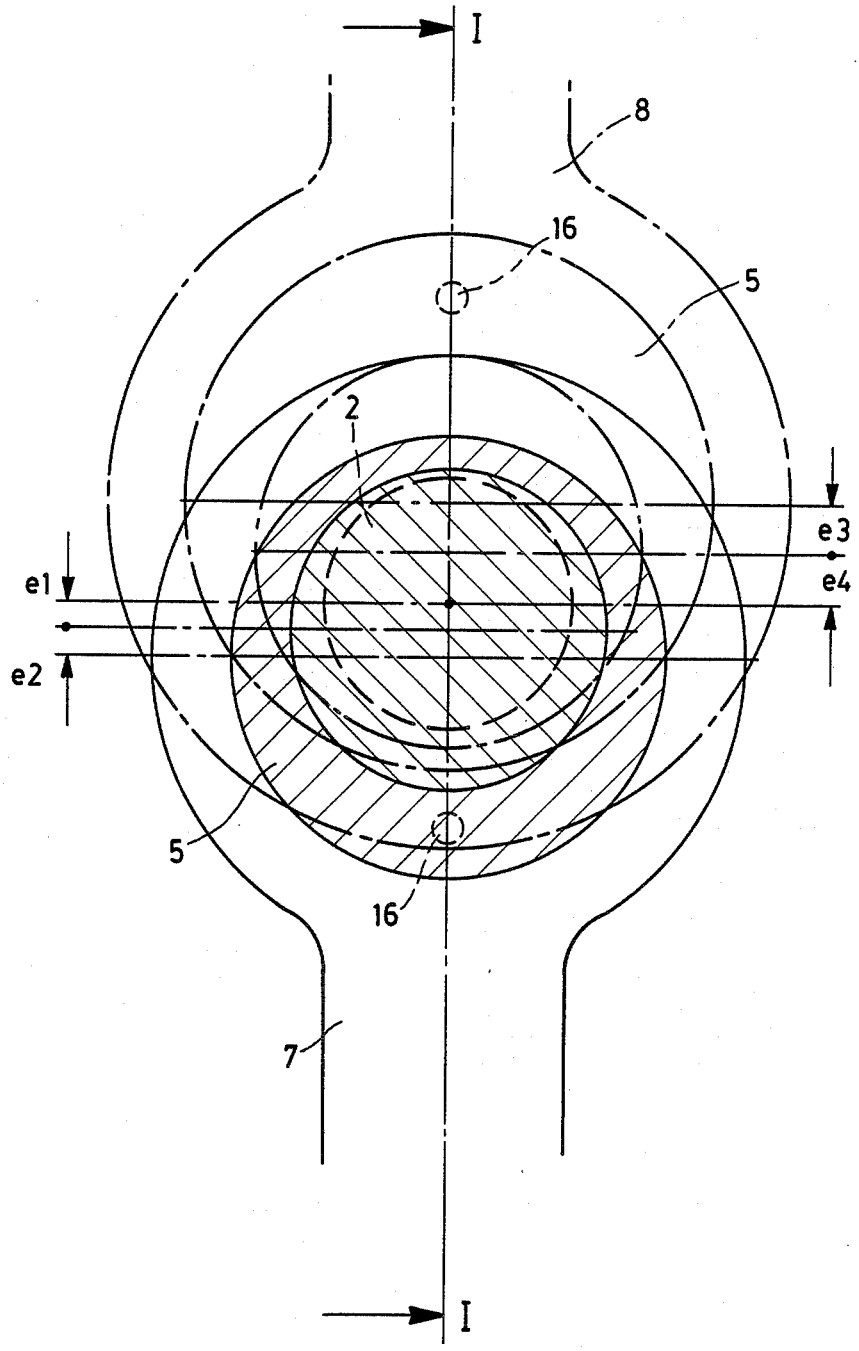
FIG. 4 is an end view of the eccentric drive taken along line III—III of FIG. 1 showing a modified eccentric drive from that shown in FIG. 3.

Referring now to the drawing wherein like reference numerals are used throughout the two views to designate like parts, an eccentric shaft 2 which is supported in a frame 1 is provided with two unidirectional eccentrics 3 (i.e., directed in the same direction) and a diametrally oppositely directed eccentric 4 which all have the same eccentricities. Eccentric bushings 5 and 6 are seated on the eccentrics 3 and 4 which also have the same eccentricities. The eccentric pairing of bushings and eccentrics can be seen by the arrows (e1, e2) and the corresponding arrows (e1′, e2′) in FiG. 3. The distances in this FIG. 3 between (e1, e2) and (e1′, e2′) are equal. The alternative arrangement of unequal eccentricities mentioned supra is shown in FIG. 4 wherein (e1, e2) remains the same, but the equal eccentric pairing (e1′, e2′) is replaced with the different eccentric (e3, e4) pairings. This latter pairing requires that the ratio of the eccentric of the bushing to the eccentric of the cooperating eccentric be the same for all bushing-eccentric pairings. Connecting rods 7 are supported on the eccentric bushings 5 which are pivotally connected at the other end thereof with a ram 9. A connecting rod 8 is supported on the eccentric bushing 6 which is pivotally connected at the other end with a compensating mass 10. Guide means for the vertical guidance of the ram 9 and of the compensating mass 10 are provided—not shown in the drawings.

One press-fit (interference-fit) connection each is formed between the cylindrical fitting surfaces externally on the eccentrics 3, 4 and internally at the eccentric bushings 5, 6 which is disengageable by supplying pressure oil through an axial pressure oil line 11 and connecting lines to a respective groove 12 in the fitting surface of each eccentric 3, 4. For that purpose, a pressure oil source with a valve connected in its output (not shown) is provided which also enables a relief of the pressure oil line 11 and therewith a bleeding of the pressure oil.

An angle transmitter disk 13 is secured coaxially on and non-rotatably with the eccentric shaft 2, to which is coordinated a sensor 14 attached spatially fixedly in the frame 1. Since such angle transmitter disks and sensors are known as such, a detailed description thereof is dispensed with herein. Three angle transmitter disks 15 are rotatably supported coaxially on the eccentric shaft 2, of which each is non-rotatably connected with a respective eccentric bushing 5 and 6 in that the eccentric bushing 5, 6 includes a unilaterally projecting pin 16 which engages in a slot 17 provided in the coordinated angle transmitter disk 15. A contactless sensor 24 spatially fixedly arranged in the frame 1 is adjacent to each angle transmitter disk 15.

Figure 1:
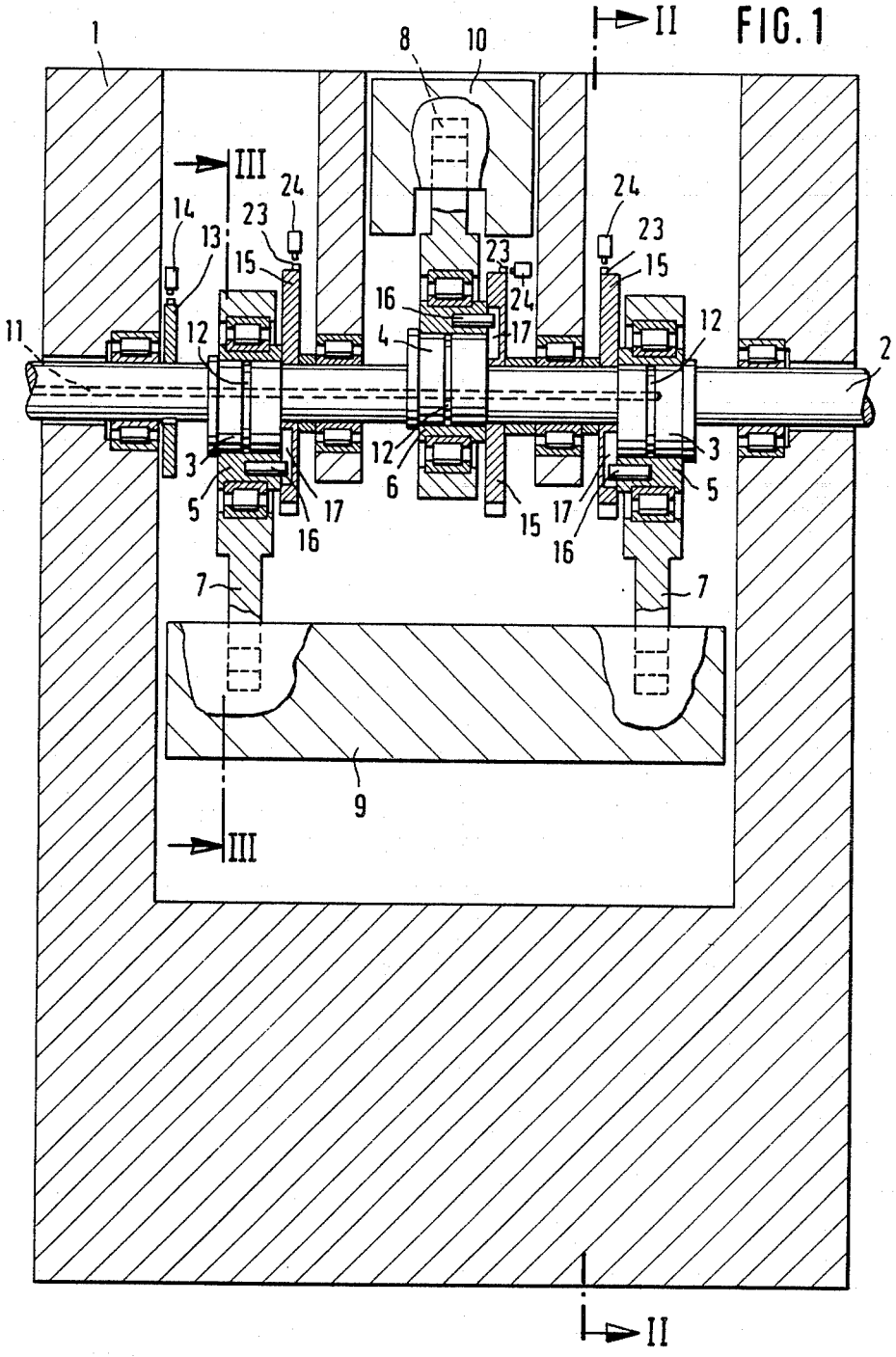
FIG. 1 is a schematic cross-sectional view, taken along line I—I of FIG. 2, and one embodiment of an arrangement according to the present invention is a two-point high-speed press with compensating mass movable opposite to the ram.
Figure 2:
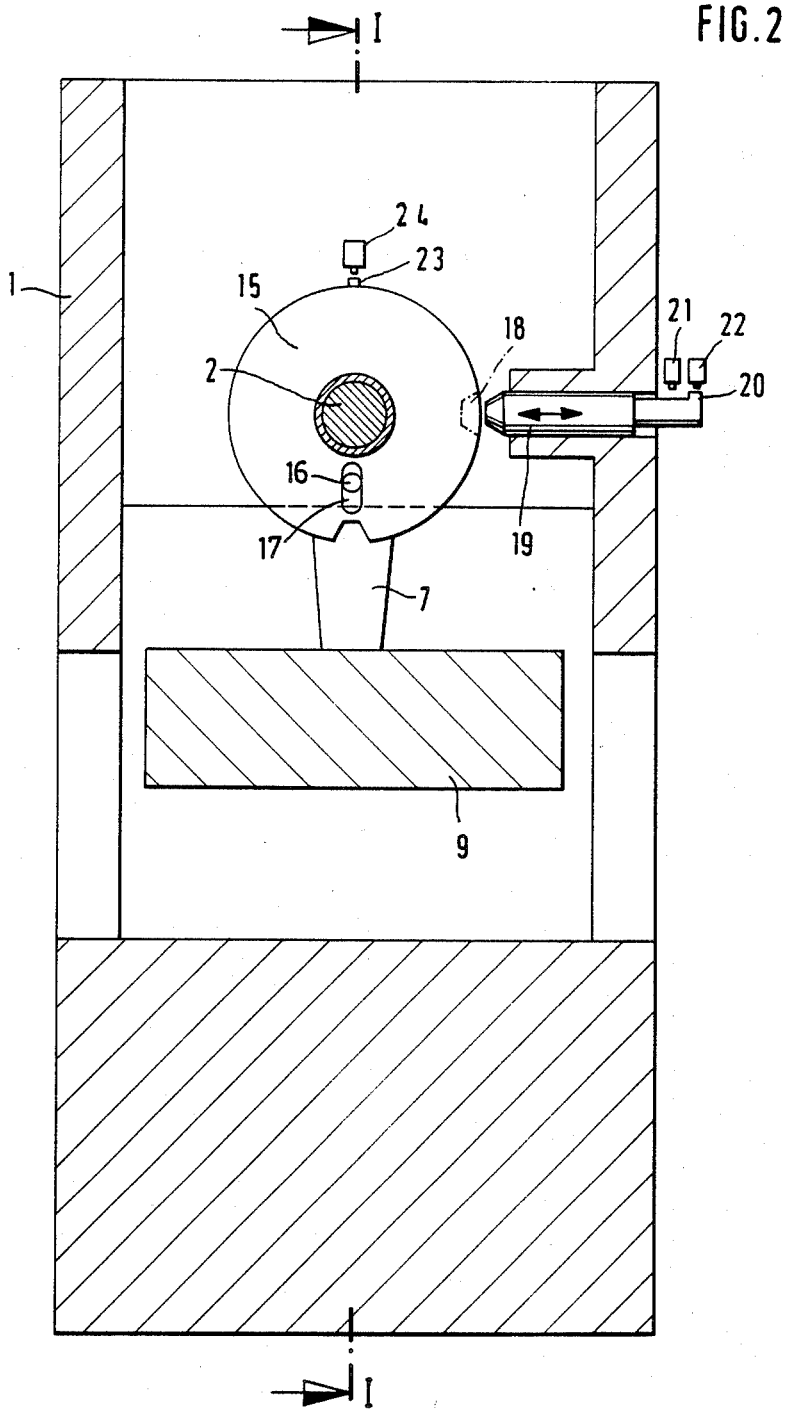
FIG. 2 is a schematic cross-sectional view taken along line II—II in FIG. 1.

Finally, each angle transmitter disk 15 includes along the outer circumference a recess 18—in the drawing illustrated only in FIG. 2 for the angle transmitter disk 15 coordinated to the eccentric bushing 6—into which a bolt 19 movable radially to the eccentric shaft 2 in a controllable manner can engage, which bolt 19 is displaceably supported in the frame 1. Each bolt 19 includes at its rear end opposite the coordinated recess 18, a nose 20 which cooperates in each of the two end positions of the bolt 19 with one of two coordinated contactless sensors 21 and 22 which are spatially fixedly secured at the frame 1.

During an adjustment of the ram stroke by means of this arrangement, one proceeds as follows. After stopping the press, the eccentric shaft 2 with eccentrics 3 and 4, eccentric bushings 5 and 6 fixedly seated thereon and angle transmitter disks 13 and 15 connected therewith are rotated into a starting position in the creep speed. This starting position corresponds to the still adjusted ram stroke and is determined in that in this starting position for the adjustment of the ram stroke to be initiated, the bolts 19 can engage into the recesses 18 and initiators 23 provided at the angle transmitter disks 15 are disposed opposite the coordinated sensors 24. Thereaching of this starting position is indicated by the sensors 24 and the eccentric shaft 2 is then stopped by turning off the drive of the creep speed. The bolts 19 are then actuated radially inwardly, which as a result thereof engage in the recesses 18 and fix the angle transmitter disks 15 and the eccentric bushings 5 and 6 in the direction of rotation. This condition is indicated by the radially inner sensors 21 whereby the noses 20 at the bolt 19 are disposed opposite to the radially inner sensors 21. By supplying pressure oil through the axial pressure oil line 11 to the fitting surfaces of the press-fit connections, the latter are then disengaged or released. Thereupon, the eccentric shaft 2 together with the eccentrics 3 and 4 is rotated by the drive of the creep speed corresponding to the preselected ram stroke. The angular rotational travel required therefor or the absolute angular position required therefor is detected by the angle transmitter disk 13 and the coordinated sensor 14. Upon reaching the correct angular position of the eccentric shaft 2, the eccentric shaft 2 is again stopped by turning off the drive of the creep speed. The pressure oil is relieved thereafter, whereupon the press fit connections between the eccentrics 3 and 4 and the eccentric bushings 5 and 6 are again re-established. Thereafter, the bolts 19 are actuated radially outwardly so that the bolts 19 no longer engage in the recesses 18. This condition is indicated by the radially outer sensors 22 whereby the noses 20 at the bolts 19 are disposed opposite these sensors 22. The press is therewith operationally ready with the newly adjusted ram stroke.

The correct angular position of the eccentric bushings 5 and 6 on the eccentrics 3 and 4 can be monitored in that the synchronism of the occurrence of the signals at the sensors 24 is monitored. With the occurrence of a deviation from the synchronism, the correct angular position of the eccentric bushings 5 and 6 on the eccentrics 3 and 4 can be re-established again in that the press-fit connections are released, the bolts 19 are acted upon radially inwardly, and the eccentric shaft 2 is rotated until all bolts 19 engage in the recesses 18 which is indicated by the sensors 21. The synchronism is thus again re-established; the press-fit connections can then again be re-established.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An arrangement in a press having a driving connection between an eccentric drive shaft and a ram for adjustment of the ram stroke including: an eccentric means; an eccentric bushing means releasibly supported on said eccentric means; a connecting rod means supported on the eccentric bushing means; actuating means for selectively releasing the eccentric bushing from the eccentric means and fixing the eccentric bushing means in a direction of rotation on the eccentric means; the eccentric bushing means, when released, being non-rotatably held with respect to the eccentric shaft while the eccentric shaft is being rotated for adjusting said ram stroke; and wherein eccentric bushing means is supported on the eccentric means with a press-fit connection utilizing plural cylindrical fitting surfaces between said eccentric means and said eccentric bushing means; and wherein said actuating means releases said press-fit connection by supplying pressure oil by way of at least one groove associated with at least one of said cylindrical fitting surfaces.

2. An arrangement according to claim 1, wherein the press-fit connection between the eccentric bushing means and the eccentric means is established in the presence of a temperature difference between these two parts.

3. An arrangement according to claim 2, wherein at least one of said cylindrical fitting surfaces is in the eccentric bushing means.

4. An arrangement according to claim 1, wherein there is an axial pressure oil line in said eccentric shaft that connects with said at least one groove.

5. An arrangement according to claim 4, wherein the eccentric shaft includes two unidirectional eccentric means of substantially the same eccentricity with eccentric bushing means supported thereon and having substantially the same eccentricity.

6. An arrangement according to claim 4, wherein there is provided at least one additional eccentric means which is disposed diametrally opposite one of said eccentric means substantially similar eccentricity, and wherein all eccentric means have a substantially similar eccentricity as said one eccentric means eccentricity and have supported thereon eccentric bushing means.

7. An arrangement according to claim 4, wherein there is provided at least one additional eccentric means which is directed diametrally opposite one of said eccentric means and having a different eccentricity; said additional eccentric means having an additional eccentric bushing means rotatable thereon; and wherein the ratio of the eccentricities of all the eccentric bushing means to the eccentricities of their eccentric means is substantially the same.

8. An arrangement according to claim 4, further comprising plural angle transmitter disk means arranged coaxially on the eccentric shaft, of which at least one is non-rotatably connected with the eccentric shaft and with an associated eccentric bushing means, and at least one spatially fixedly arranged contactless sensor adjacent to said at least one angle transmitting disk means.

9. An arrangement according to claim 5, wherein the eccentric shaft includes at least one additional eccentric means which is disposed diametrally opposite to at least another eccentric means, said additional eccentric means having a substantially similar eccentricity as said at least another eccentric means, and wherein eccentric bushing means of substantially similar eccentricity are supported on all eccentric means.

10. An arrangement according to claim 5, wherein the eccentric shaft includes at least one additional eccentric means which is directed diametrically opposite at least one eccentric means of different eccentricity, and wherein the ratio of the eccentricity of one of the eccentric bushing means to the eccentricity of an associated eccentric means is substantially the same in connection with all eccentric bushing and eccentric means.

11. An arrangement according to claim 1, further comprising plural angle transmitter disk means arranged coaxially on the eccentric shaft, of which at least one is non-rotatably connected with the eccentric shaft and with an associated eccentric bushing means, and at least one spatially fixedly arranged contactless sensor adjacent to said at least one angle transmitter disk means.

* * * * *